United States Patent [19]

Yoshino

[11] Patent Number: 4,595,418

[45] Date of Patent: Jun. 17, 1986

[54] PRODUCTION OF POWDERY MALTOSE

[75] Inventor: Zenichi Yoshino, Kashihara, Japan

[73] Assignee: Sanwa Kosan Kabushiki Kaisha, Kashihara, Japan

[21] Appl. No.: 663,919

[22] Filed: Oct. 23, 1984

[30] Foreign Application Priority Data

Oct. 25, 1983 [JP] Japan ..... 58-199862

[51] Int. Cl.[4] ..... C13K 7/00

[52] U.S. Cl. ..... 127/30; 127/38; 127/46.2; 127/60; 127/61; 435/95; 435/99; 435/100

[58] Field of Search ..... 34/57 R; 159/4 S, 4.01; 435/95, 96, 99, 100; 127/30, 38, 40, 42, 46.2, 46.3, 58, 60, 61

[56] References Cited

U.S. PATENT DOCUMENTS

| | | | |
|---|---|---|---|
| 3,677,896 | 7/1972 | Kurimoto et al. | 435/95 |
| 3,713,978 | 1/1973 | Kurimoto et al. | 435/95 X |
| 4,099,982 | 7/1978 | Hansen et al. | 159/4 S |
| 4,199,372 | 4/1980 | Walon | 127/40 |
| 4,409,033 | 10/1983 | LeRoy | 127/46.3 X |
| 4,487,198 | 12/1984 | Miyake et al. | 127/30 X |

OTHER PUBLICATIONS

Hodge, J. E. et al.; "Useful Properties of Maltose"; Cereal Science Today, Jul., 1972, vol. 17, No. 7, pp. 180–188.

*Primary Examiner*—Richard V. Fisher
*Assistant Examiner*—W. Gary Jones
*Attorney, Agent, or Firm*—Armstrong, Nikaido, Marmelstein & Kubovcik

[57] ABSTRACT

Powdery crystalline maltose characterized by a high concentration of the beta-anomer of maltose monohydrate is produced by:

(1) obtaining a high purity maltose solution containing not less than 90% maltose and not more than 2.5% maltotriose by enzymatic saccharification of a liquefied starch solution having a low degree of hydrolysis;

(2) concentrating the high purity maltose solution to a solid content of 65 to 80%;

(3) adding seed crystals of beta-maltose monohydrate;

(4) precipitating maltose monohydrate crystals in a primary crystallization stage;

(5) spray drying the resulting massecuite to obtain a powdery product with a water content of 5.5–7.5%; and (6) aging the powdery product at a temperature of 50°–75° C., relative humidity of 50–70% and absolute humidity of 45–185 g water/Kg dry air.

A product having low hygroscopicity is produced by this method.

5 Claims, 2 Drawing Figures

PRODUCTION OF POWDERY MALTOSE

Figure 1:
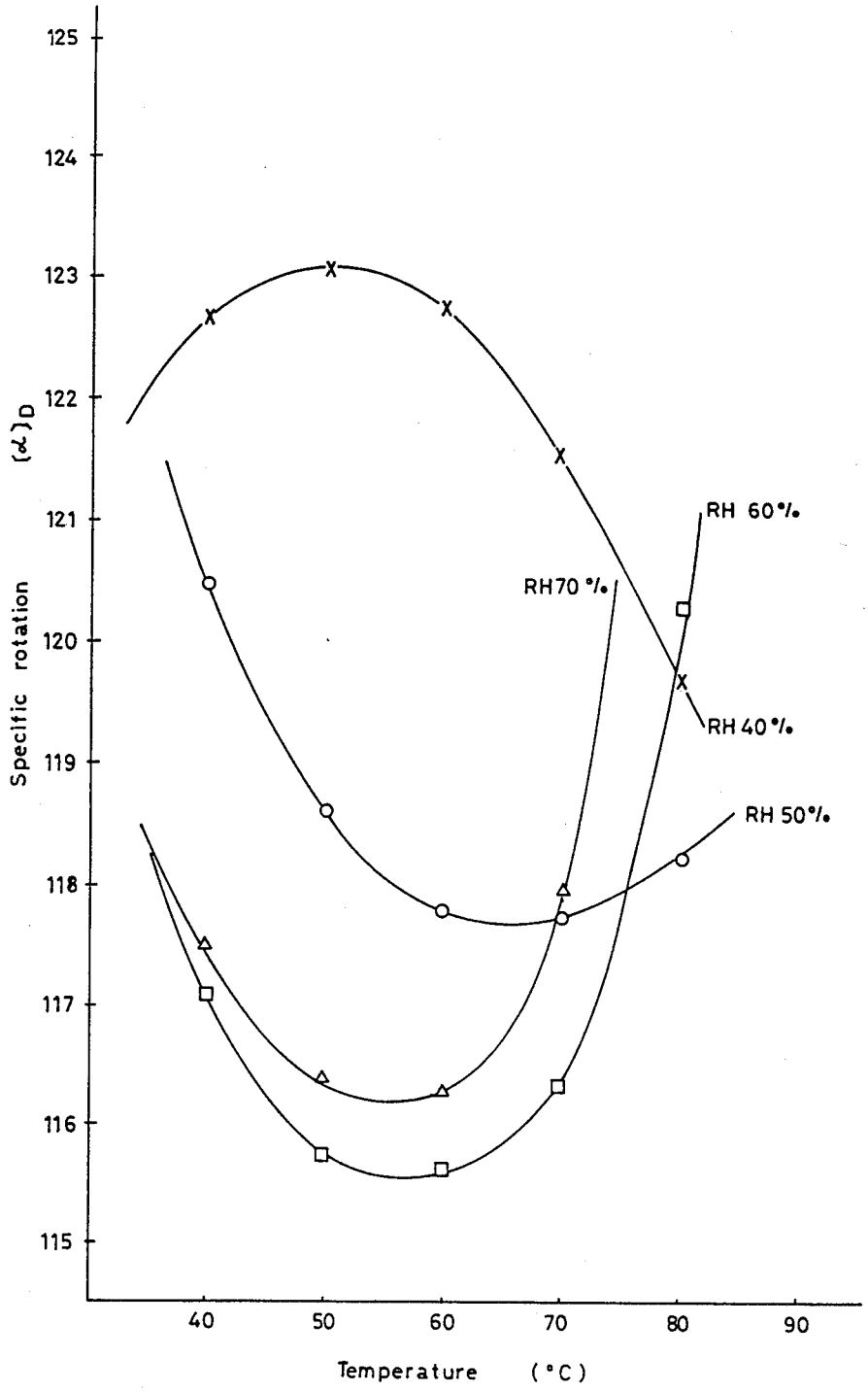

The present invention relates to a method for producing powdery maltose which is of low hygroscopicity and readily soluble in water.

A known technique for producing powdery maltose generally comprises two steps, i.e.

(1) saccharification of starch to obtain a saccharified solution and (2) powderization of the saccharified solution, and these steps are correlated with each other.

The generally well-known method to obtain a saccharified solution having as high a maltose content as possible is one in which starch is liquefied by means of α-amylase (EC No. 3.2.1.1.), acid or mechanical treatment while controlling the hydrolysis to a minimized degree, and then both β-amylase (EC No. 3.2.1.2.) and a debranching enzyme (pullulanase EC No. 3.2.1.41., isoamylase EC No. 3.2.1.68) are caused to act on the liquefied starch solution at the same time to obtain a saccharified solution. When this method is employed, the sugar composition of the resulting saccharified solution will be 85 to 92% of maltose, a small amount of glucose and more than several percents of maltotriose and oligosaccharides of several polymerization degrees. With the progress of hydrolysis in the liquefaction, there increases a chance in which chain molecules of an odd number of glucose units are formed, this being a reason for the formation of maltotriose (Japanese Patent Publication Nos. 37849/1971, 24060/1971, 13089/1972, 3937/1979, 3938/1979, 9739/1977, etc.). In the above method, a liquefied starch solution with an extremely low degree of hydrolysis and low viscosity is obtained by liquefying a starch solution having a starch concentration of 20% or less by the mechanical liquefaction method, and therefore, a high-purity maltose solution of a low maltotriose content can be obtained by saccharifying said solution with β-amylase (e.g. of soybean origin) exhibiting a saccharification activity in the vicinity of 60° C. and a debranching enzyme of microbial origin. In this case, retrogradation of starch molecules can be prevented by adding a proper amount of α-amylase at a proper time in the saccharification stage. Also, among microorganisms are those such as *Streptomyces hygroscopicus,* etc. which can produce enzymes which are α-amylase but are also capable of producing not less than 75% of maltose by the hydrolysis of starch. This enzyme not only produces maltose and maltotriose by the hydrolysis of starch, but also acts on the maltotriose to cut it into maltose and glucose, then produces maltotetraose from the resulting glucose and the maltotriose by transglucosidation and then cuts the maltotetraose into two molecules of maltose. It is also known that glucoamylase has a higher affinity to high molecular substrates with a large reaction rate. By the utilization of a proper combination of the substrate specificities of these enzymes, a high-purity maltose-containing saccharified solution of a low maltotriose content can be prepared. As other methods, there may be mentioned those in which only β-amylase is caused to act on a liquefied starch solution of the same low degree of hydrolysis as above, or a proper amount of α-amylase is added in the course of the reaction, thereby producing a saccharified solution containing 60 to 70% of maltose (based on the total sugar) and β-limit dextrin (molecule having a branch bond) as the rest. Removal of this β-limit dextrin therefrom will result in a high-purity maltose solution. However, also in this case, the amount of maltotriose increases with the progress of hydrolysis on liquefaction, and in practice, several percents or more of maltotriose are produced as by-product.

Known methods for powderizing the above produced maltose-containing saccharified solution include the so-called total sugar method, spray-drying method (Japanese Patent Publication Nos. 3937/1979 and 23325/1979), crystal separation method and the like. The total sugar method is a method in which a saccharified solution having a maltose concentration of not less than 80% (based on the total sugar) is concentrated to form β-maltose monohydrate crystals, thereby solidifying the whole system as a solid mass. This solidified product, after being aged for a proper period of time, is chipped and sieved into a powder. The commercial products produced by this method contain 85% of maltose, about 5% each of maltotriose, glucose and dextrin and about 6% of water. It is however well known that, when said products are allowed to stand in an atmosphere in which the temperature is 30° C. and the relative humidity (hereinafter referred to as RH) is 80%, they take up about 3% water only after one day, reaching a water content of about 9 to 9.3%, and that they take up water to about 9% also when the temperature is 25° C. and the relative humidity is 80% [refer to Starch Science Handbook, p. 457 (1977), Asakura Shoten, Tokyo, Japan]. Further, such commercial products contain fine particles which, although sieved, take some time to dissolve in water. For this reason, the sparingly soluble particles even in a small amount cause a fatal defect in uses in which the powder is directly added without being dissolved in water and kneaded as in minced fish meat, chocolate, etc.

The spray-drying method can provide products superior in solubility, but the amorphous or non-crystalline powder, because of its extremely high hygroscopicity, becomes a problem as a commercial product (Starch Science Handbook, p. 457, 1977, published by Asakura Shoten). For this reason, a method has been proposed in which, after concentrating the maltose solution, the resulting massecuite containing partly deposited crystals is spray-dried (Japanese Patent Publication No. 3937/1979). The term "Massceuite" as used here means a maltose syrup containing microcrystals of maltose. In this method, the saccharified solution is concentrated to 70 to 80%, seed crystals are added at about 35° C. to form crystals over 1 to 3 days until the rate of crystallization reaches not less than 35%. The resulting massecuite is sprayed into a drying column while feeding a hot dry air of 80° C. to 90° C. into the column, and the powdery product is slowly withdrawn on a conveying belt from the bottom of the column while blowing 40° C. warm air up from below the belt. The dry powder thus obtained is filled in an ageing column, and its crystallization and drying are finished by passing warm air through the column for about 10 hours to obtain a powder having a water content of 6%. This method, on considering its process, is a combination of primary crystallization, spray-drying and ageing intended to maintain a complete crystal form. The present inventors also studied this method, and as a result thereof, found that, because it takes a long time for the primary crystallization and ageing, design of continuous process is almost impossible and also impractical in terms of cost. Further, the product is still high in hygroscopicity and therefore not practically useful.

In view of the facts described above, the present inventors made an extensive study while referring to the already known methods with the object of providing a continuous process for producing maltose crystalline powders which have a low hygroscopicity, no adhesiveness, free-flowing good flowability and easy solubility and which can be kneaded, in its powdery form, into minced fish meat, chocolate, etc., and as a result, have found that the desired objects can be attained by a combination of some particular conditions. The present inventors thus arrived at the present invention.

According to the present invention, there is provided a method for producing powdery maltose characterized in that a high-purity maltose solution, the sugar composition being not less than 90% of maltose and not more than 2.5% of maltotriose, obtained by the enzymatic hydrolysis of a liquefied starch solution of a low degree of hydrolysis is concentrated to a solid content of 65 to 80%, seed crystals are added thereto and primary crystals are precipitated at a crystallization temperature of 25±5° C. until the degree of crystallization (i.e. as dry maltose based on the solid content in the massecuite) reaches 50±5%, the resulting massecuite is spray-dried to form maltose powder, which is then aged under high temperature and high humidity conditions to complete the β-anomerization and crystallization of maltose monohydrate.

In a preferred embodiment of the above process, the spray-dryed product, immediately after the spray-drying, is subjected to ageing by exposing the same to a high temperature high humidity atmosphere satisfying the conditions that the temperature is 50°-75° C., the relative humidity is 50-70% and absolute humidity is 45-185 g. water/kg. dry air, to complete the β-anomerization and crystallization.

In any case it is preferable that the spray-drying is so conducted that the water content of the powder right after the spray-drying is 5.5-7.5%.

When the viscosity of the massecuite after the primary crystallization is too high it is preferable to add a proper amount of the same maltose solution as mentioned above thereto to lower the viscosity at the crystallization temperature to be not higher than 70,000 centipoises, before subjecting the same to the spray-drying.

The powderization according to the present invention may be said to be the same as the known methods explained hereinbefore in that it comprises the crystallization of primary crystals, spray-drying and ageing. However the process of the present invention is novel and distinctive in the selection and combination of the above mentioned particular conditions.

Figure 2:
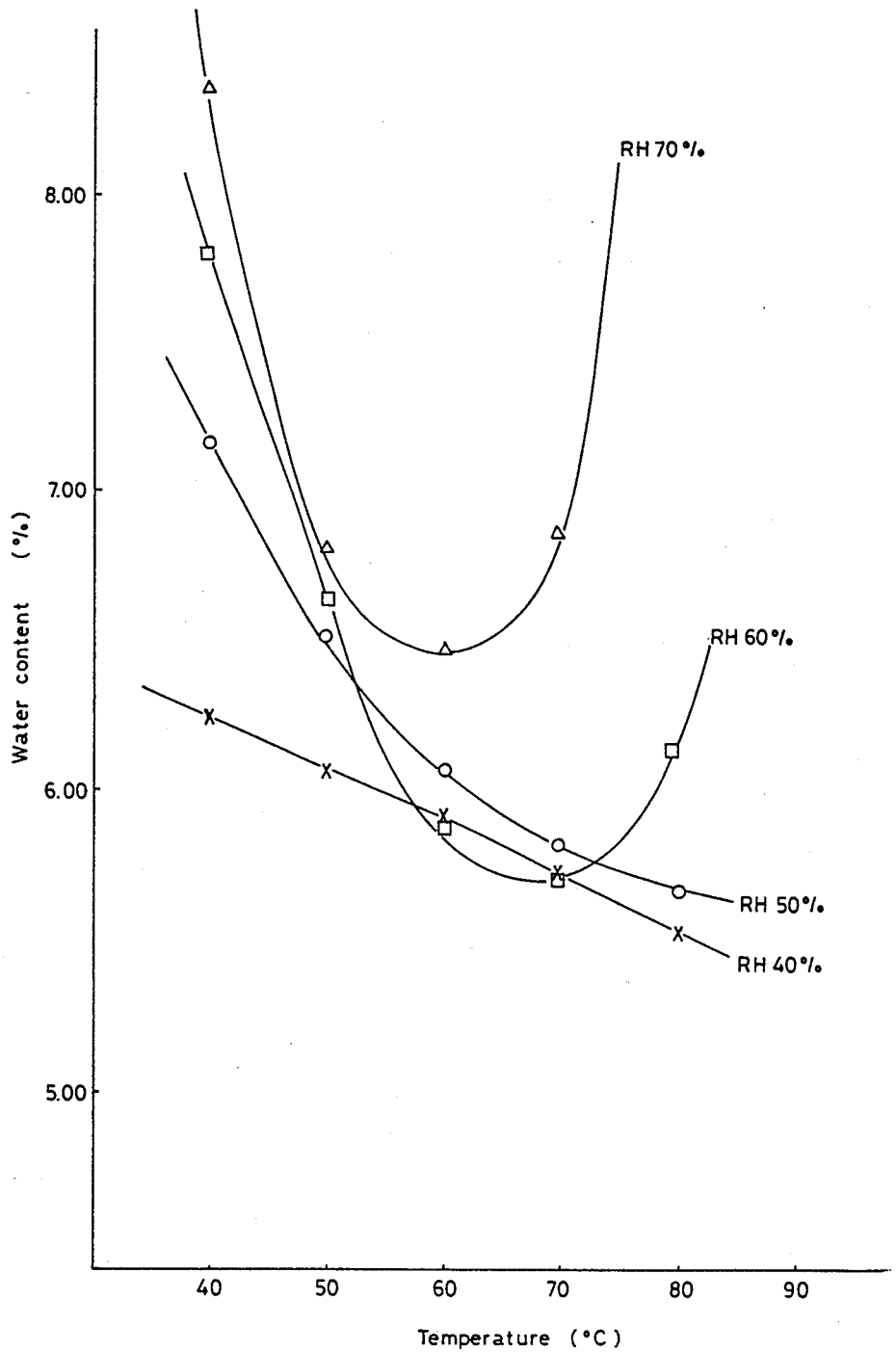

The present invention will be explained in more detail as follows by referring partly to the accompanying drawings wherein FIG. 1 is a graph illustrating the relationship between the temperature/humidity condition at ageing step and the specific rotation of the product, and FIG. 2 is a graph illustrating the relationship between the temperature/humidity condition at ageing step and water content of the product.

The present inventors have found some novel facts in the course of comparison and investigation of relationships between, on the one hand, the sugar composition of maltose solutions and, on the other hand, the primary crystallizability, spray-dryability and ageability thereof and the hygroscopicity and equilibrium water content of the product.

First, the present inventors have found that the maltotriose content of a maltose solution exerts a considerable effect on the crystallizability of primary crystals, viscosity of the massecuite and hygroscopicity (equilibrium water content) of the product. Thus, it has been found that the effect of content of glucose, maltotetrarose and maltopentaose is small as compared with that of the maltotriose content, but that, by reducing the maltotriose content in the maltose solution to not more than 2.5% (based on the total sugar in the solution), the formation of primary crystals of maltose becomes very easy, and that the viscosity of the massecuite, at crystallization degree of 50±5% and Brix degree (hereinafter referred to as Bx) of 68 to 72 becomes not more than 40,000 cp, whereby spray-drying of the massecuite becomes very easy.

Further, it has been found to be preferable that the spray-drying condition be regulated so that the water content of the spray-dried product is 5.5 to 7.5%, and that said product be aged in a high temperature and high humidity atmosphere wherein, preferably, the temperature is 50° to 75° C. the relative humidity is 50 to 70% and the absolute humidity is 45 to 185 g water/kg dry air.

In order to obtain a solution of both low maltotriose content and high maltose content, it is known that the starch concentration in the starting material should be lowered and the enzyme should be used in well selected conditions. However, practically, it is very difficult to obtain the desired object directly. Therefore, when control of the maltotriose content to not more than 2.5% is attempted as in the present invention, it is practical to subject the saccharified solution to a chromatographic separation technique using adsorbents. More particularly, there may be used the selective adsorption/elution method with anion-exchange resins (Japanese Patent Publication Nos. 4239/1981 and 46290/1977) which is known per se. According to this method, an aqueous solution with an extremely high maltose purity (89 to 98% based on the total sugar) can be obtained. However it is preferable to utilize a simulated moving bed system with porous Na-type cation-exchange resins. A saccharified solution can be fractionated into maltose and higher-order polymeric oligosaccharides than maltotriose by the simulated moving bed method. For example, when a saccharified solution with a sugar composition of 60 to 70% of maltose the remaining component being β-limit dextrin, as obtained by saccharifying the before mentioned liquefied starch solution of a low degree of hydrolysis with β-amylase only, is subjected to the separation procedure described above, it is divided into two fractions under normal conditions, i.e. a maltose fraction of about 55 to 65% based on the total sugar and an oligosaccharide fraction of about 35 to 45% based thereon. And, the rate of fractionation to the maltose fraction of various saccharides is 70 to 80% for maltose and 55 to 65% for glucose, while that of maltotriose and other oligosaccharides is only 8 to 15%, most of them moving to the oligosaccharide fraction. Consequently, this means that the maltose fraction not containing more than 2.5% of maltotriose is obtained by one separation operation in an amount of about 55 to about 65% based on the total sugar weight in the starting solution. The oligosaccharide fraction may be saccharified into glucose by the action of glucoamylase when it is added to a saccharification vessel for producing glucose, so that it can be utilized without a loss.

Thus, by properly utilizing the above mentioned methods, there may be obtained a saccharified aqueous solution with a sugar composition of not less than 90% of maltose and not more than 2.5% of maltotriose by the enzymatic hydrolysis of a liquefied starch solution of a low degree of hydrolysis (e.g. dextrose equivalent or DE value of less than 10, preferably 3–7) and subsequent separation of high molecular oligosaccharides. The high purity maltose solution is then subjected to the primary crystallization, spray-drying and ageing to be explained below.

What is important to the desired powderization of maltose is to take its crystal form into account. The β-maltose monohydrated crystal is nonhygroscopic and the β-maltose anhydrous crystal is hygroscopic. The α,β-complex crystalline maltose also has an advantage that it is not so different from the β-maltose hydrate in hygroscopicity, easily soluble and easily crystallized from a viscous liquid. However, anomerization proceeds as α,β-complex crystalline maltose takes up water and finally turns to β-maltose monohydrate, from which the β-maltose monohydrate is considered to be the most stable form (Hodge, et al., Cereal Science Today, 1972). The β-form can easily be distinguished from the α-form by measuring the specific rotation.

In the method of the present invention, about 45% to about 55% of maltose contained in the saccharified solution (high purity maltose solution) is precipitated as crystals or microcrystals at the primary or first crystallization step, and the resulting massecuite is spray-dried to evaporate most of the water, whereby the water content of the spray-dried product is made 5.5 to 7.5% which is larger than the 5% necessary for crystallization. At this point, about 20% to about 30% of maltose still remains in the form of α-anomer. For this reason, the subsequent ageing step should include those conditions under which absorption of water necessary for crystallization, conversion to β-anomer, formation of hydrated crystals and drying (removal of excess water) can be effected. The present inventors have found that the ageing step of the known methods focus only on drying so that a long period of time is required. For example, according to Japanese Patent Publication No. 27325/1979 wherein a saccharified solution containing 7.5 to 11.5% of maltotriose is used for ageing, the ageing is conducted under the conditions that the solution is aged for 5 to 18 hours in 25° C.×60% RH, 28° C.×64% RH and 30° C.×60% RH which correspond to 10 to 16 g water/kg dry air of absolute humidity, and then for 12 to 16 hours in a low-humidity air. In order to carry out such a prolonged ageing, equipment-related costs are very high.

The present inventors have extensively studied with an emphasis on converting to β-maltose monohydrate crystals in as short a time as possible, and have found that the foregoing water absorption, β-anomerization, formation of hydrated crystals and drying can be carried out in a short time under limited high temperature/high humidity conditions.

The dried powdery maltose was measured with respect to the following four properties: (1) hygroscopicity, (2) equilibrium water content, (3) free-flowability and (4) specific rotation.

The hygroscopicity was tested by allowing the test sample to stand for 1 to 7 days at 30° C. and a relative humidity of 80%, during which the water gain was measured with the lapse of time. In this test, the water content at the time of equilibrium was indicated as equilibrium water content. The free-flowability was judged in terms of the following four grades, A, B, C and D, according to the state of the test sample after 24 hours of the above hygroscopicity test:

A: Keeps the same free-flowing powdery form as at the start of the hygroscopicity test.

B,C,D: Lumps are formed, and whether or not the lumps easily collapse is observed.

The specific rotation was determined as follows: Five grams (on dry basis) of the sample was dissolved in 50 ml of dimethylformamide (DMF), and optical rotation was measured on the layer of 200 mm thick of the solution and its five-fold value was indicated as specific rotation $[\alpha]_D$.

The powderization steps of the present invention will be successively explained in more detail as follows. The sugar composition of saccharified solution, as described above, shall be as follows: Maltotriose content, not more than 2.5% and maltose content, not less than 90%. This solution is concentrated to precipitate primary maltose crystals.

A thermostable α-Amylase (SPITASE HS Nagase & Co., Ltd.) was caused to act on a liquefied starch solution (20% starch content), as obtained by the well-known mechanical liquefaction method, at 105° C. to make the degree of hydrolysis 1.3. The solution, after being adjusted to a pH of 4.5, was saccharified at 60° C. for 24 hours with the addition of a commercial β-amylase of soybean origin. The saccharified solution, after being purified by the usual method, was separated into a maltose fraction and an oligosaccharide fraction by chromatography of a simulated moving bed system with a Na type cation-exchange resin. By mixing both fractions in various proportions maltose solutions having different maltotriose content were prepared. The powderization experiment was carried out using these solutions according to the method of the present invention. The results are shown in Table 1.

TABLE 1

| Sample | Comparison of powderization of maltose solutions having different maltotriose contents | | |
|---|---|---|---|
| | A | B | C |
| Sugar composition (%) | | | |
| Glucose | 1.0 | 1.0 | 1.0 |
| Maltose | 90.9 | 89.6 | 90.4 |
| Maltotriose | 0.5 | 2.5 | 4.0 |
| $G_4$ or higher | 7.6 | 6.9 | 4.6 |
| Condition for rate of crystallization to reach 50 ± 5% | Bx 72.0, 30° C., 12 hours | Bx 74.8 30° C., 12 hours | Bx 79.8 30° C., 12 hours |
| Degree of supersaturation of the maltose | 1.52 | 1.58 | 1.70 |

TABLE 1-continued

| Sample | Comparison of powderization of maltose solutions having different maltotriose contents A | B | C |
|---|---|---|---|
| solution | | | |
| Viscosity of the same solution as above (c.p.) | 11200 | 83500 | 1160000 |
| Spraying condition | Direct spraying | Diluted to Bx 72 with a Bx 49/30° C. maltose solution and sprayed 30500 cp 30° C. | Diluted to Bx 68 with a Bx 49/30° C. maltose solution and sprayed 20800 cp 30° C. |
| Ageing condition | 60° C., 65% RH, 2 hours | 60° C., 65% RH, 2 hours | 60° C., 65% RH, 2 hours |
| Product | | | |
| Equilibrium water content | 7.51% | 8.07% | 9.12% |
| Specific rotation $[\alpha]_D$ | +115.0 | +118.0 | +119.8 |
| Free-flowability | A | B | C |

The degree of concentration necessary for the primary crystallization is in the range of 65 to 80% (as solid content), and its lower values will suffice when the maltose purity is higher and the maltotriose content is lower.

As shown in Table 1, Bx 72 will suffice for a case wherein the maltose content is about 91% and the maltotriose content is less than 1%, and even Bx 65 will suffice for a maltose content of about 95%. But, a Bx range of 75 to 80 is essential when the maltotriose content is more than 2%. The amount of seed crystals added is not a very important factor and generally, a range of 0.1 to 1.0% (as solid maltose based on the total sugar) will be sufficient.

The crystallization temperature is preferably within a range of 25±5° C. in view of economy and operability.

The rate of crystallization needs to be advanced to 50±5%. The viscosity of a massecuite at the point when the primary crystallization has been finished varies largely depending upon the content of maltotriose. When the massecuite has a viscosity of less than 30,000 cp (at the crystallization temperature), it may be subjected at once to spray drying. When the massecuite containing the primary crystals has a viscosity higher than that, it is diluted to a viscosity of less than 70,000 cp, preferably about 30,000 cp, by mixing the same with a proper amount of a maltose solution of the same temperature as the massecuite obtained by concentrating a saccharified solution of the same sugar composition until the saturation (but before the crystallization) of maltose contained therein, and then subjected to spray-drying.

As a spray drier, there may be used any of a rotating disc atomizer type and a nozzle atomizer type, and the hot air flow in the drier may be any of a horizontal parallel flow, a vertical downward parallel flow and a vertical mixed upward flow. Preferably, however, combinations of a rotating disc type atomizer and a vertical downward parallel flow or vertical mixed upward flow are used. The temperature and flow rate of dry hot air and the flow rate of massecuite should properly be controlled so that the water content of the resulting dry powder is within a range of 5.5 to 7.5%. Consequently, the flow rates of dry hot air and massecuite are determined on condition that the temperature of hot air is within a range of 80° to 120° C.

The next important point concerns the ageing conditions after spray drying. All the powders obtained by spray drying are not yet in fully grown-up β-maltose monohydrated crystalline form, and about 20 to about 30% of α-maltose is contained in the maltose powder.

A powdery maltose was prepared by concentrating a saccharified solution (sugar composition: maltose content 92.5% and maltotriose content 2.2%) to a concentration of 75% to carry out primary crystallization, spray-drying the resulting massecuite (water content 5.5 to 6.0%) and ageing the resulting powder under a condition, 30° C.×55% RH, similar to the well-known ones. The hygroscopicity test (after standing for three days) and free-flowability test (after standing for one day) were carried out on the powdery maltose to determine the required ageing time. The results are collectively shown in Table 2, from which it has been found that all the samples required a long ageing time of 10 hours or longer.

The hygroscopicity test on a commercial powdery maltose (water content, 6.33%) was also carried out at the same time, and it was found that the water gain was 2.93% after one day, 3.20% after two days and 3.25% after seven days, which shows that the maltose was stabilized after it took about 3% water. The equilibrium water content at that time was 9.3%.

TABLE 2

| Test No. | Crystalline state before ageing | Ageing time at 30° C. × 55% RH — Ageing time (hours) 2 | 4 | 6 | 8 | 10 | 12 | 16 | 18 | Time required for formation of β-hydrated crystals (hrs.) |
|---|---|---|---|---|---|---|---|---|---|---|
| 1 | Normal crystal | 1.55 D | 1.37 C | 1.32 C | 1.37 B | 1.23 A | 1.20 A | 1.23 A | | 10 |
| 2 | Microcrystal | 1.35 C | 1.23 C | 1.25 B | 1.28 B | 1.22 A | 1.10 A | 1.21 A | | 10 |
| 3 | " | 1.34 C | 1.29 C | 1.21 B | 1.28 B | 1.26 A | 1.14 A | 1.11 A | | 10 |
| 4 | Normal crystal | 1.08 D | 1.06 D | 1.03 C | 1.12 B | 0.93 A | 1.04 A | 1.02 A | | 10 |

TABLE 2-continued

| Test No. | Crystalline state before ageing | Ageing time at 30° C. × 55% RH: Ageing time (hours) 2 | 4 | 6 | 8 | 10 | 12 | 16 | 18 | Time required for formation of β-hydrated crystals (hrs.) |
|---|---|---|---|---|---|---|---|---|---|---|
| 5 | Normal crystal | 1.18 D | 1.08 D | 1.12 D | 1.02 D | 1.07 D | 0.95 D | 0.36 B | 0.49 A | 18 |
| 6 | Microcrystal | 1.04 D | 1.10 D | 0.97 D | 0.93 D | 1.06 D | 1.12 D | 1.16 A | 1.17 A | 16 |

Remarks:
In the table, numerical values at the left hand show the hygroscopicity rate (%) and symbols at the right hand show free-flowability In view of the above, the present inventors have studied a wide range of the temperature/humidity conditions and, unexpectedly, have found that particular high temperature/high humidity conditions outside the conventional recognition are much more preferable for ageing to attain the object of the present invention. Thus, the present inventors have carried out ageing under various conditions of 40° C. to 80° C. (temperature)×40 to 70% (RH), taking samples with the lapse of time and measuring specific rotation, water content, hygroscopicity and free-flowability of the product. The results are shown in part in FIGS. 1 and 2. FIG. 1 shows the specific rotation after 2 hours' ageing and FIG. 2 the water content after 2 hours' ageing. By overall judgement from these results, it has been found that, when the temperature×humidity condition is 50° C.×preferably 60–70% RH, 60° C.×preferably 50–70% RH or 70° C.×preferably 50–70% RH, a completely aged powdery maltose stabilized in both β-anomerization and water content is obtained by the ageing time of only 2 hours or shorter.

Contrary to this, at temperatures lower than 50° C., both β-anomerization and drying take a long period of time and fail to attain the object of the present invention. Under higher temperature (exceeding 75° C.)/high humidity conditions, not only both β-anomerization and drying take a long period of time, but also a slight change in temperature (e.g. change in atmospheric temperature) during operation produces condensed water, so that such temperatures are not practical.

When the humidity is as low as less than 50% RH, drying can be carried out sufficiently, but β-anomerization takes a long period of time. Consequently, drying is finished before the completion of β-anomerization, so that the desired stable maltose powder is not obtained.

As described above, the particular powderization conditions in the ageing after spray-drying of the present invention have not been known before. The process is characterized in that, by carrying out ageing in the high temperature/high humidity conditions of such limited range as specified above, all of the water absorption necessary for spray-dried powders for crystallization, β-anomerization, formation of hydrated crystals and drying (removal of excess water) is attained in an ageing time of only 2 hours or less, whereby stabilized free-flowable crysatlline powdery maltose of low hygroscopicity can be obtained. This is therefore very useful in designing a continuous process.

As a result of free-flowability and hygroscopicity tests on the test samples thus obtained, the following was further found: The ageing needs to be carried out in an atmosphere satisfying the condition that the temperature be 50° to 75° C., relative humidity be 50 to 70%, and absolute humidity be 45 to 185 g water/kg dry air. Under this condition, water absorption takes place for the first 30 minutes and then excess water is removed by drying, whereby stabilized low-hygroscopicity powdery maltose crystals having a water content of 5 to 7% and specific rotation of less than $[\alpha]_D+118°$ (DMF, dry basis) can be produced.

Of these ageing conditions, the most preferred one is 60° to 70° C. and RH 62 to 68% and 90 to 150 g water/kg dry air of absolute humidity. Under this condition, stabilized low-hygroscopicity crystalline maltose powder having a water content of 5 to 6% and specific rotation $[\alpha]_D$ of 114 to 117 can be produced with a good reproducibility.

What is further preferable is that the powder should uniformly be aged at any portion in the high temperature high humidity. The ageing test was carried out as follows. The spray-dried sample was placed in a cylindrical vessel equipped with a wire net at the bottom in varying layer depths of 5, 10 and 20 cm, and aged while passing hot air through the wire net from the bottom so that the atmosphere in the vessel was 60° C.×65% RH (absolute humidity, 91 g water/kg dry air). As a result, it has been found that complete anomerization from α-maltose to β-maltose takes about 1.5 hours for a depth of 5 to 10 cm, and about 2 hours for that of 20 cm. Further, also from the results of hygroscopicity test, sensory test and water content test, it has been found that, with the column type ageing apparatus, the sample layer can not be more than 20 cm in depth. The present inventors thus have found that it is preferred to use a moving belt conveyer or fluidized-bed type ageing apparatus so that the ageing step comprising water absorption, anomerization and crystallization can be carried out continuously and uniformly in the atmosphere described above.

Therefore in a preferred embodiment of the present invention, the dry powder coming out of the spray-dryer is immediately discharged onto a continuous fluidized bed type ageing apparatus in a thin layer and is continuously passed through an atmosphere satisfying the above mentioned high temperature-high humidity conditions until the desired ageing is completed. When the aged product has a high moisture content (e.g. more than 7%) it is preferable to dry the same to a moisture content of 5–6.5%. This drying can also be conducted continuously with hot-air by a belt-conveyor or fluidized bed type drier.

The invention will be illustrated further specifically with reference to the following examples.

EXAMPLE 1

A liquefied starch solution of a low degree of hydrolysis [dextrose equivalent (DE), 6.0] was prepared by causing α-amylase (SPITASE HS, produced by Nagase & Co., Ltd.) to act on a 30% aqueous solution of commercial corn starch (produced by Sanwa Denpun K.K.) according to the well-known method. To the solution was added a commercial β-amylase of soybean origin (produced by Nagase & Co., Ltd.) in an amount of 0.2% based on the starch (as dry basis), and the saccharification reaction was carried out at pH 5.0 and at 60° C. for 24 hours to obtain a saccharified solution of a sugar composition of 60% maltose and 9.8% maltotriose. The resulting solution, after being subjected to filtration, decoloration, purification with ion-exchange resin and concentration by the usual method, was freed from oligosaccharides by simulated moving bed system chromatography on Na-type cation-exchange resin (Mitsubishi Chemical Industries, Ltd.) to obtain a high-purity maltose solution (fraction) corresponding to 58% of the total sugar. The sugar composition of this high-purity maltose solution determined by high-performance liquid chromatography (HPLC) is as follows:

| | |
|---|---|
| Glucose | 1.0% |
| Maltose | 90.9% |
| Maltotriose | 0.5% |
| DP ≧ 4 | 7.6% |

This solution was concentrated to Bx by 72 by vacuum concentration, and 5 kg of the resulting concentrate was charged to a closed vessel type crystallizer (6 liters in volume) equipped with a temperature-controlling jacket and a stirrer. At the point when the temperature of the solution reached 30° C. (degree of supersaturation of maltose, 1.52), seeds (β-maltose monohydrate-containing massecuite of the same composition as that of the above concentrate) were added at a rate of 0.5% (as converted to the dry maltose basis) based on the solid content of the solution, and primary-crystallization was carried out at 30° C. for 12 hours at 80 rpm. The massecuite obtained by the crystallization was found to contain β-maltose hydrate fine crystals (triangular plate like crystals of about 20μ in size by microscopic observation) and the crystallization degree was 48%, as converted to the dry maltose basis, based on the solid content of the massecuite. The viscosity of the massecuite was 11,200 cp (B-type viscometer). This massecuite was directly dried in a spray-drier comprising a rotating disc type atomizer and a vertical downward parallel flow type blower while maintaining the hot air inlet at 80° C., to obtain a flowing powder having a water content of 6.2%.

This powder was immediately spread in a thickness of about 0.5 to about 1.0 cm in a constant-temperature/-constant-humidity oven kept at 60° C. and 65% RH (absolute humidity, 91 g water/kg dry air), and aged for 2 hours. The powder after ageing had a water content of 6.4% and a specific rotation $[\alpha]_{DMF}$ of +115.0°, and showed little hygroscopicity even in an atmosphere of 30° C.×80% RH and kept a powdery form excellent in flowability. The equilibrium water content in the same condition was 7.5%.

EXAMPLE 2

In the same manner as in Example 1, a high-purity maltose solution of a sugar composition of 89.6% maltose and 2.5% maltotriose was obtained.

This solution was concentrated to Bx 74.8 and primary-crystallized for 12 hours in the crystallizer described above under the conditions that the temperature of the solution is 30° C. (degree of supersaturation of maltose, 1.58); amount of seed is 0.5% and a number of rotations is 80 rpm.

The massecuite on completion of the primary-crystallization was found to contain a large number of β-maltose hydrate fine crystals and the degree of crystallization was 47%. The viscosity was 83,500 cp. This massecuite was diluted to Bx 72 by mixing with 11% (based on the massecuite) of a Bx 49 solution of the same composition and temperature, so as to have a crystal content of 47% and a viscosity of 30,500 cp. The resulting massecuite was spray-dried in the same manner as in Example 1 to obtain a powder having a water content of 5.8%. Immediately thereafter, the powder was aged for 2 hours on a fluidized-bed type ageing apparatus in an atmosphere of 60° C.×65% RH, and then dried for 2 hours in a hot-air drier kept at 40° C. to obtain a powdery maltose.

This powder had a water content of 6.2% and a specific rotation $[\alpha]_{DMF}$ of +118.0°, showed little hygroscopicity under a condition of 30° C.×80% RH and kept a powdery form excellent in flowability.

EXAMPLE 3

A liquefied starch solution of a low degree of hydrolysis (DE 1.0), as prepared in a manner similar to Example 1 using a 20% aqueous slurry of commercial potato starch, was saccharified for 72 hours to obtain a saccharified solution of a sugar composition of 70% maltose and 6% maltotriose. The resulting solution, after being subjected to filtration, decoloration, purification with ion-exchange resin and concentration by the usual method, was freed from oligosaccharides by simulated moving bed system chromatography on Na-type cation-exchange resin to obtain a high-purity maltose solution (fraction) with a sugar composition of 96.2% maltose and 1.1% maltotriose. The yield of maltose in the maltose fraction was 62% based on the total sugar. The maltose solution thus obtained was concentrated to Bx 65 and primary-crystallized for 12 hours under the conditions that the temperature of the solution is 20° C. (degree of supersaturation of maltose, 1.59) the amount of seed is 0.5% and the number of rotations is 80 rpm. The massecuite thus obtained had a degree of crystallization of 52% and a viscosity of 25,000 cp. This massecuite was directly spray-dried while keeping the hot air inlet at 80° C., to obtain a powder having a water content of 5.5%. This powder was then aged for 2 hours in a closed type constant-temperature/constant humidity oven kept at 60° C. and 65% RH to obtain a powdery maltose.

This powder had a water content of 6.0% and a specific rotation $[\alpha]_D$+114° (DMF, dry basis), showed little hygroscopicity under the condition of 30° C.×80% RH and kept a powdery form excellent in flowability. The equilibrium water content in the same condition was 6.5%.

EXAMPLE 4

This example illustrates the production of powdery maltose on an industrial plant capable of producing powdered crystalline maltose of about 80 tons/day.

A corn starch slurry having a concentration of 25%, after adjusting its pH to 6.0, was liquefied in the same manner as in Example 1 on a continuous J-cooker with addition of a proper amount of bacterial α-amylase. The resulting liquiefied solution of DE 6.0 was saccharified at 55° C. for 48 hours with addition of β-amylase and pseudomonas isoamylase. The resulting saccharified solution had the following sugar composition: Maltose, 75%; glucose, 0.5%; maltotriose, 15%; and the rest, maltooligosaccharides which are a higher-order polymer than maltotetrasaccharide. This solution was purified as usual with activated carbon and ion-exchange resin, and concentrated to a concentration of 60% on an evaporator.

In the same manner as in Example 1, the concentrate was separated into a maltose fraction and an oligosaccharide fraction by simulated moving bed system column chromatography on Na-type cation-exchange resin.

The maltose fraction corresponded to 65% of the total sugar, and its sugar composition was 95% of maltose, 2% of maltotriose and 1% of glucose. This fraction was concentrated to Bx 68% on an evaporator and transferred to the 1st crystallizer, and after adding 0.5% of seed crystals, kept at a constant temperature of 30° C. for 12 hours with stirring. The degree of crystallization after 12 hours was 47%, and the viscosity of the resulting massecuite was 62,000 cp.

The massecuite was dried on a spray-drier to obtain a powder having a water content of 5.1%. The spray-drier used here was a large-sized one of the same type as used in Example 1 comprising a rotating disc type atomizer and a vertical parallel downward flow type blower. In this case, the massecuite was supplied to the atomizer from the upper part of the drying chamber by means of a usual pump. The downward flow of hot air was passed in parallel with the flow of the massecuite. The inlet temperature of hot air was kept at 95° C. and the outlet temperature was 74° to 75° C. on a normal run. The spray-dried product was continuously withdrawn from the bottom of the drying chamber and immediately transferred to the subsequent ageing step. As the ageing apparatus there was used a continuous fluidized-bed type ageing apparatus. The atmosphere in the apparatus was adjusted to 65° C.×70% RH. The time required for the spray-dried product to pass through the ageing apparatus was fixed to 4 hours. During this period, water absorption, conversion to $\beta$-anomer and formation of hydrated crystals were carried out. The water content of the aged product at the outlet was 7.2%. This product was then led to a belt conveyor type drier wherein it was dried into a final product by hot air. The physical properties of the final product were as follows: Water content, 6.1%; free-flowability, A (free-flowing powdery form); and specific rotation $[\alpha]_D$ +115° (DMF, dry basis).

Incidentally the fluidized bed type ageing apparatus is similar to a well known fluidized bed dryer except that a temperature and humidity controlling device is associated therewith in place of a hot-air blower. The said apparatus may be batchwise, but continuous type is preferable for large scale industrial production.

What is claimed is:

1. A method of producing powdery crystalline maltose characterized by a high concentration of the beta-anomer of maltose monohydrate comprising the steps of
   (1) obtaining a high purity maltose solution with a sugar composition of not less than 90% of maltose and not more than 2.5% of maltotriose by enzymatic saccharification of a liquefied starch solution characterized by a low degree of hydrolysis,
   (2) concentrating said high purity maltose solution to a solid content of 65 to 80%,
   (3) adding seed crystals containing beta-maltose monohydrate to the concentrated solution,
   (4) conducting a primary crystallization whereby maltose monohydrate crystals are precipitated at a temperature of 25±5° C. until the degree of crystallization reaches 50±5%,
   (5) spray drying the resulting massecuite to obtain a powdery product having a water content of 5.5–7.5%, and
   (6) aging the powder product by exposing it immediately after the spray-drying to an atmosphere wherein the temperature is 50°–75° C., the relative humidity is 50–70%, and the absolute humidity is 45–185 g water/kg dry air to convert alpha-maltose to beta-maltose and complete the crystallization of maltose monohydrate.

2. A method as claimed in claim 1 wherein, when the viscosity of the massecuite after the primary crystallization is too high, a proper amount of a maltose solution is added thereto to lower the viscosity of the massecuite at the crystallization temperature to less than 70,000 cps, before subjecting the resulting massecuite to the spray-drying.

3. A method as claimed in claim 1 wherein, after the enzymatic saccharification, the saccharified solution is separated into a high purity maltose-containing fraction and an oligosaccharide-containing fraction by simulated moving bed system chromatography with a cation-exchange resin, to obtain the high purity maltose solution.

4. A method as claimed in claim 1 wherein the spray-drying is conducted by the use of a parallel flow type spray-drier with a rotating disc type atomizer, the inlet hot air temperature being 80°–120° C.

5. A method as claimed in claim 1 wherein the aging is conducted continuously on a continuous belt conveyor type or continuous fluidized bed type ageing apparatus.

* * * * *